United States Patent [19]

Price et al.

[11] Patent Number: 4,517,442

[45] Date of Patent: May 14, 1985

[54] SHOE PART HEATING APPARATUS

[75] Inventors: Frank C. Price; Nigel R. Tout; Raymond Hanson; Malcolm Tillyard, all of Leicester, England

[73] Assignee: USM Corporation, Farmington, Conn.

[21] Appl. No.: 482,869

[22] Filed: Apr. 7, 1983

[30] Foreign Application Priority Data

Apr. 17, 1982 [GB] United Kingdom ..... 8211206

[51] Int. Cl.[3] ..... H05B 3/06; A43D 95/12

[52] U.S. Cl. ..... 219/215; 219/521; 219/405; 219/348; 219/354; 12/59.7; 12/41.5

[58] Field of Search ..... 219/215, 521, 405, 411, 219/354, 348, 347, 85 BA, 85 BM, 385; 12/1 A, 41.5, 59.7

[56] References Cited

U.S. PATENT DOCUMENTS 2,672,545 3/1954 Alderman ..... 219/215
3,105,891 10/1963 Gibbard ..... 219/521
3,199,130 8/1965 Sprague ..... 12/59.7
3,485,486 12/1969 Siemer ..... 219/354
3,517,160 6/1970 Maga ..... 219/215
3,533,117 10/1970 Dinolfo ..... 12/1 A

FOREIGN PATENT DOCUMENTS 700678 12/1953 United Kingdom ..... 219/385

*Primary Examiner*—C. L. Albritton
*Assistant Examiner*—Teresa J. Walberg
*Attorney, Agent, or Firm*—Donald N. Halgren

[57] ABSTRACT

The apparatus comprises a support for a shoe part which is to have adhesive on a surface thereof activated by heat, and a heating member arranged to emit infra-red radiation to heat the shoe part. The heating member is mounted for movement between an operative position thereof in which the heating member is in opposed relationship with the support so that the shoe part can be heated, and an inoperative position in which the heating member is substantially enclosed by infra-red radiation reflecting screens.

15 Claims, 3 Drawing Figures

18
36
100
52
48
16
60
98
90
62
91
40
44
92
82
106
94
26
10
96
37
24
110
38
112
86
14
108
88
122
124
104
114
118
12
34
120
92
78
80
94
37
76
74
70
110
72
64
56
116
30
22
66
62
68
32
54
50
58
28
102

SHOE PART HEATING APPARATUS

BACKGROUND OF THE INVENTION

1. Field of the Invention

This invention is concerned with apparatus for use in heating a shoe part to activate adhesive on a surface thereof, the apparatus comprising a heating member arranged to emit infra-red radiation, and a support for a shoe part on which a shoe part can be positioned to be heated by infra-red radiation emitted by the heating member.

2. Prior Art

In the specification of our copending U.S. Pat. No. 325,384, there is described an apparatus in which a heating member in the shape of a plate emits infra-red radiation towards a support for a lasted shoe upper above the heating member and towards a support for a shoe sole beneath the heating member. In this apparatus, the continuous surface of the heating member avoids color sensitivity problems and the need to move the heating member to conform to the surface of a shoe part is also avoided. However, in this apparatus, because the heating member is continuously maintained at high temperature and because the heating member is uncovered except for a wire mesh support for a lasted shoe upper, not only is the operator of the apparatus exposed to an uncomfortable amount of infra-red radiation but also the energy consumption of the apparatus is undesirably high as a considerable amount of heat escapes when no shoe part is on the support.

It is an object of the present invention to provide apparatus for use in heating a shoe part in which the exposure of an operator of the apparatus to infra-red radiation is reduced and the energy consumption of the apparatus is reduced in comparison to the apparatus described above.

BRIEF SUMMARY OF THE INVENTION

The invention provides apparatus for use in heating a shoe part to activate adhesive on a surface thereof, the apparatus comprising a heating member arranged to emit infra-red radiation, and a support for a shoe part on which a shoe part can be positioned to be heated by infra-red radiation emitted by the heating member, wherein the heating member is mounted for movement between an operative position thereof in which the heating member is in opposed relationship with the support, and an inoperative position in which the heating member is substantially enclosed by infra-red radiation reflecting screens.

In order that the speed of operation of the apparatus may be increased by enabling an operator to load a further support while adhesive is activated on a shoe part on the support, the apparatus comprises a further support for a shoe part and the heating member is movable to a further operative position thereof in which the heating member is in opposed relationship with the further support.

In order that the heating member may be rapidly returned to its inoperative position after heating a shoe part, the heating member is arranged to pass through its inoperative position in moving between its operative positions.

In order to enable the apparatus to operate automatically, the apparatus comprises control means operative to control moving means of the apparatus which is operable to move the heating member as aforesaid, the control means being operative to cause the heating member to be moved from its inoperative position to an operative position thereof, be held at the operative position for a predetermined time, and then be returned to its inoperative position. The predetermined time may be between 4 and 8 seconds, since this period is found to be suitable for many adhesives. As it is convenient for an operator to feed shoe parts to the support and the further support alternately, the control means is operative to cause the heating member to be moved to its two operative positions alternately.

In order to enable lasted shoe uppers and the soles to be attached thereto to be processed together, the support is arranged to support a lasted shoe upper and the apparatus also comprises a support for a sole to be attached to a lasted shoe upper, the support for a sole being arranged opposite the support for a lasted shoe upper so that the heating member when in its operative position can simultaneously heat both a lasted shoe upper and a sole.

The heating member is in the form of a plate of greater extent than the support for a shoe part so that the shoe part receives radiation which is substantially uniform and the advantages of the above-mentioned apparatus are retained. So that the heating member conforms more exactly to the shape of the shoe part, the heating member comprises two generally planar portions inclined to one another at an angle of between 140° and 160°.

In order to reduce the loss of heat from the heating member, the edges of the heating member are substantially enclosed in infra-red radiation reflecting screens which move with the heating member, these screens assisting in enclosing the heating member when it is in its inoperative position.

In order to reduce any uneven heating which might occur at the edges of the heating member, infra-red reflecting screens which move with the heating member extend from the periphery of the heating element so that, when the heating member is in an operative position thereof, the screens direct infra-red radiation towards the support.

In order that the apparatus may be used either for activating adhesive on either a sole of a lasted shoe upper or alternatively for activating adhesive on both a sole and a lasted shoe upper simultaneously, the heating member is arranged to be maintained at two alternative temperatures, a first temperature between 540° C. and 500° C. or a second temperature between 390° C. and 350° C.

Since the heating member is enclosed in infra-red radiation reflecting screens for a substantial proportion of the operating period of the apparatus, an operator of the apparatus is exposed to less radiation, the radiation only leaving the apparatus when the heating member is out of its inoperative position and much of the radiation emitted at this time falling on the shoe part. Furthermore, as the operator has normally positioned the shoe part on the support and removed his hand from the vicinity of the support by the time the heating member emerges from its inoperative position, the radiation is less likely to fall directly on the operator. Additionally, as a considerable proportion of the infra-red radiation emitted by the heating member is reflected back to it, less energy is required to maintain the heating member at its working temperature.

BRIEF DESCRIPTION OF THE DRAWINGS

There now follows a detailed description, to be read with reference to the accompanying drawings, of an apparatus for use in heating shoe parts which is illustrative of the invention. The illustrative apparatus has been selected for description by way of example and not of limitation of the invention.

In the drawings.

DESCRIPTION OF THE PREFERRED EMBODIMENT

Figure 1:
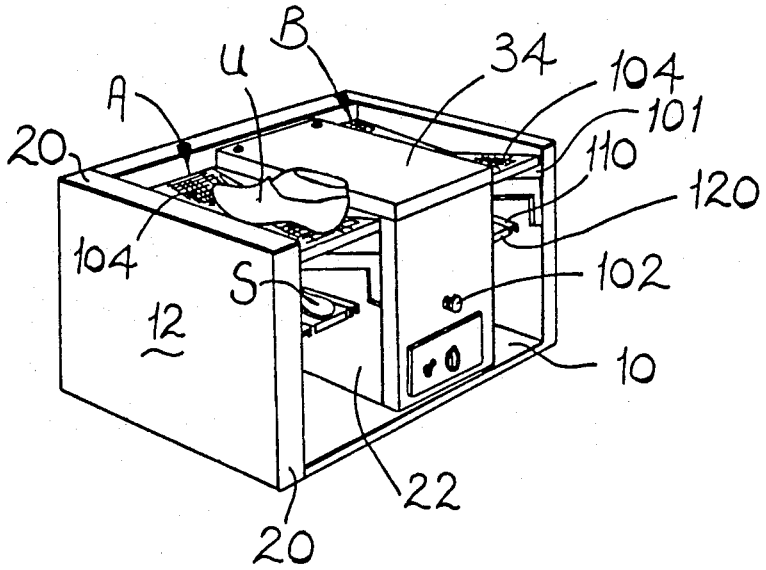
FIG. 1 is a perspective view of the illustrative apparatus.

The apparatus shown in the drawings is for use in heating a shoe part to activate adhesive on a surface thereof. The apparatus comprises a supporting frame work made of aluminium sheet material. The framework comprises a base 10, outer left and right hand side plates 12 projecting upwardly from the base 10, inner left and right hand side plates 14 spaced from the plates 12 so that an insulating gap is formed between each pair of plates 12 and 14, an inner back plate 16 projecting upwardly from the base 10 and joining the plates 14, and an outer back plate 16 projecting upwardly from the base 10 and joining the plates 14, and an outer back plate 18 spaced from the plate 16, shown best in FIG. 3. Thus, the frame work forms a rectangular box with no front or top and with insulating spaces at the sides and back as shown in FIG. 1. Plates 20 serve to join the edges of the side plates 12 and 14 on the left and right hand sides of the apparatus and to join the edges of the plates 16 and 18.

Figure 2:
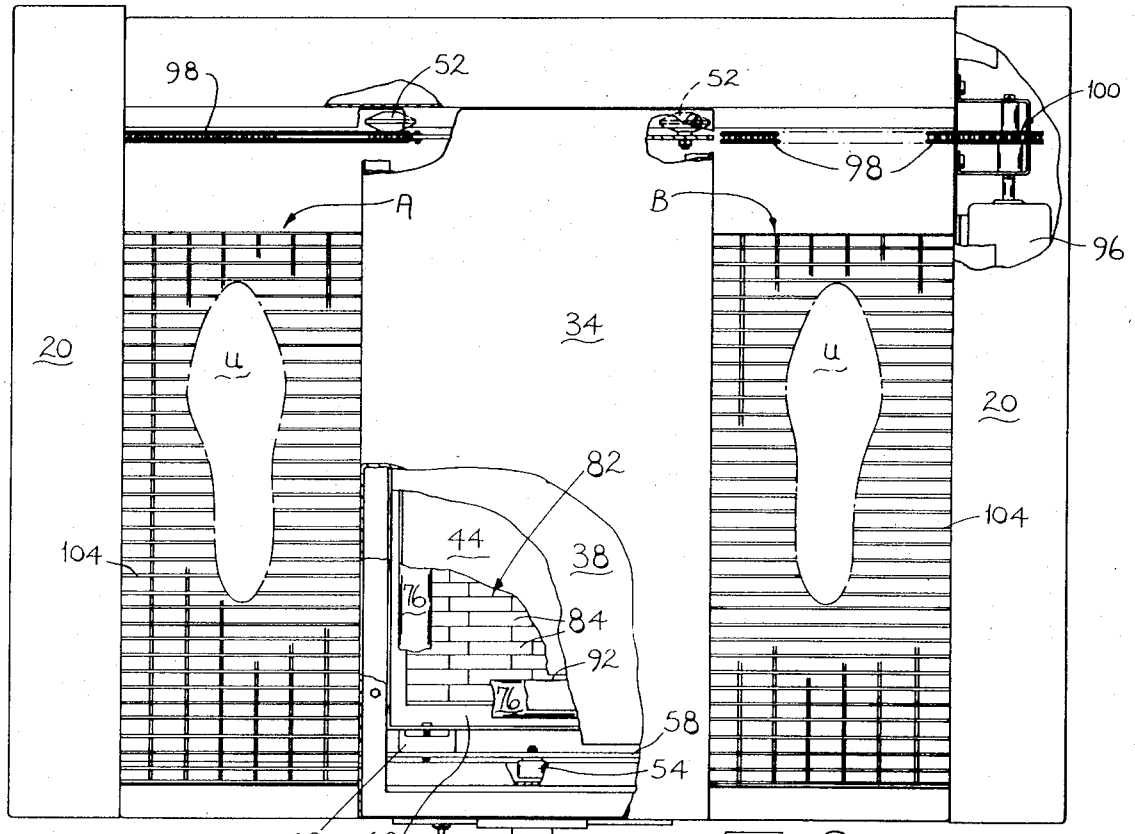
FIG. 2 is a plan view, on a larger scale than FIG. 1, of the illustrative apparatus.
Figure 3:
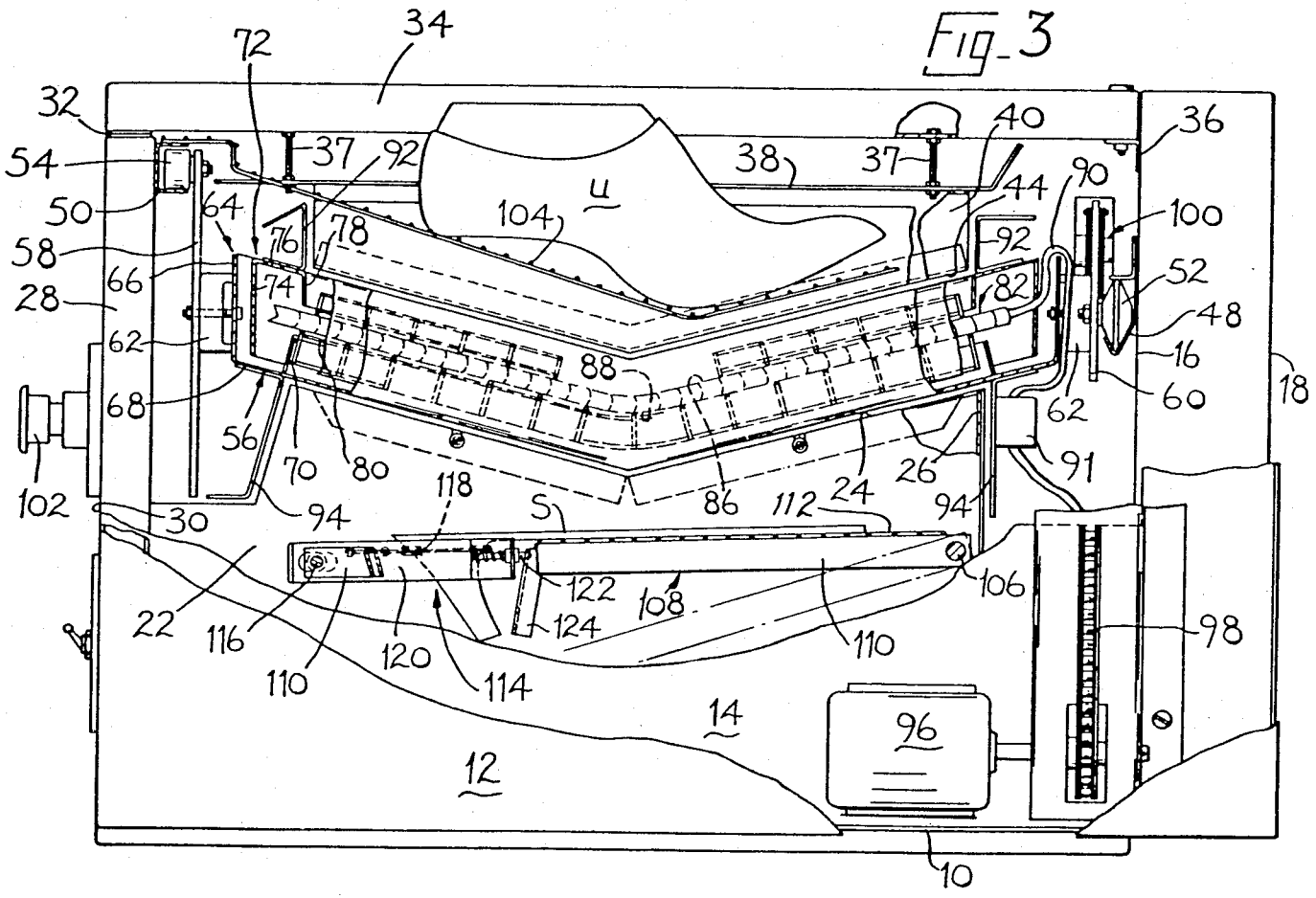
FIG. 3 is a side elevational view, with parts broken way, of the illustrative apparatus.

The space between the two inner side plates 14 is divided into three by two aluminium plates 22 which extend upwardly from the base 10 parallel to the side plates 14, the space between the left hand side plate 14 and the left hand plate 22 being a first operating station A of the apparatus and the space between the right hand side plate 14 and the right hand plate 22 being a second operating station B as shown in FIG. 2. The plates 22 do not extend as far from the base 10 as do the plates 12, 14, 16 and 18 and the upper edge of each plate 22 is in the shape of a V, with the angle between the straight portions of the V being about 150°. The upper edges of the two plates 22 are joined by an infra-red radiation reflecting screen 24 made of sheet aluminium which is V-shaped in transverse cross-section to conform to the shape of the upper edges of the plates 22. At the back of the apparatus the plates 22 are interconnected by a plate 26 which also engages the back edge of the screen 24, there being a space between the plate 26 and the inner back plate 16, as shown in FIG. 3. At the front of the apparatus, the plates 22 are secured to backwardly-extending flanges 28 of a plate 30 which extends upwardly from the base 10.

At the top thereof, the plate 30 supports a hinge 32 on which a lid 34 is hinged. The lid 34 extends between the operating stations A and B from the plate 30 to the inner back plate 16 where the lid 34 is supported by a bracket 36 carried by the plate 16. The lid 34 supports four downwardly extending bolts 37 which support a horizontal plate 38. The horizontal plate 38 supports two pairs of side walls 40, each pair defining an insulating space, which extend downwardly and have V-shaped lower edges which are of complementary shape to the upper edges of the plates 22. The two outer plates 40 are directly above and spaced from the plates 22. The side plates 40 support an infra-red reflecting screen 44 which is V-shaped in transverse cross-section and is spaced from and directly above the screen 24.

The inner back plate 16 supports a rail 48 which extends from the left hand side plate 14 to the right hand side plate 14. A further rail 50 extends between the plates 14 at the front of the apparatus and is supported by the plates 14 and 30. The rail 48 is V-shaped in transverse cross-section, as shown in FIG. 3, so that it provides location for two rollers 52 which run along the rail 48.

The rollers 52 and a roller 54 which runs along the rail 50 carry a carriage 56 which can move between the two operating stations A and B passing through the space between the screens 24 and 44. The carriage 56 comprises a vertically-extending plate 58 on which the roller 54 is mounted and a vertically-extending plate 60 on which the rollers 52 are mounted. The plates 58 and 60 are joined by spacers 62 to a rectangular frame of the carriage 56 which is made of four angle pieces 64 joined together. When viewed in transverse cross-section the frame formed by the pieces 64 is V-shaped as shown in FIG. 3, to correspond to the space between the screens 24 and 44. Each piece 64 is made of sheet aluminum and comprises a substantially vertical outside portion 66, an approximately horizontal portion 68 extending inwardly from the portion 66, and an approximately vertical portion 70 extending upwardly from the portion 68. The carriage also comprises a second frame made of four angle pieces 72 of aluminium sheet joined together. The second frame is fitted into and carried by the frame formed by the angle pieces 64. Each angle piece 72 comprises a vertically-extending portion 74 extending parallel to a portion 66 of a piece 64 and joined thereto by supporting members (not shown), an approximately horizontal portion 76 extending inwardly from the portion 74, and an approximately vertical portion 78 extending downwardly from the portion 76 and aligned with a portion 68 of a piece 64. The second frame of the carriage 56 formed by the angle pieces 72 supports a wire mesh 80 which supports a heating member 82 of the apparatus. The carriage 56 is arranged to be moved by moving means (to be described below) so that the heating member 82 is carried between the operating station A and B of the apparatus.

The heating member 82 is arranged to emit infra-red radiation which is used to activate adhesive. The heating member 82 is in the form of a plate made up of an array of ceramic blocks 84 which have electrical heating elements embedded therein and passing from block 84 to block. The heating member 82 is V-shaped in transverse cross-section having two generally planar portions inclined to one another at about 150°, as shown in FIG. 3. The heating member 82 has an upper heating surface 86 and a lower heating surface 88 which rests on the mesh 80. As shown in FIG. 3, the edges of the heating member 82 extend between the portions 70 and 78 of the angle pieces 64 and 72 respectively. Thus, the edges of the heating member 82 are substantially enclosed in infra-red radiation reflecting screens formed by the angle pieces 64 and 72, which screens move with the heating member 82. It is found that this arrangement reduces loss of heat from the heating member 82. The heating member 82 is supplied with electrical power through a wire 90 which passes through the portion 74 at the back of the apparatus and is connected to a connector 91 which is in turn connected to a loop of wire (not shown) which allows for the movement of the carriage 56.

In order to reduce any uneven heating which might otherwise occur at the edges of the heating surface 86 and 88, the carriage 56 carries infra-red radiation reflecting screens which extend from the periphery of the heating member 82. These screens are provided, in the case of the upper heating surface 86 by the vertically-extending portions 78 of the angle pieces 72 and are continued by vertically-extending portions of angle pieces 92 which are mounted on the angle pieces 72, and in the case of the lower heating surface 88 by the approximately vertically-extending portions 70 of the angle pieces 64 and are continued by vertically-extending portions of angle pieces 94 which are mounted on the angle pieces 64. As will appear from the description below, when the heating member 82 is in an operative position thereof, these screens direct infra-red radiation towards supports for shoe parts.

The moving means of the apparatus which is operable to move the heating member 82 comprises a motor 96 which is operable to move a chain 98 which passes around sprockets 100 and is attached to opposite ends of the plate 60 of the carriage 56. The moving means is controlled by control means including a start button 102, a timer and microswitches (not shown) so that the moving means operates to move the heating member 82 between operative positions thereof at the stations A and B and an inoperative position thereof in which the heating member 82 is substantially enclosed by the infra-red reflecting screens 24, 44 and those formed by the angle pieces 64 and 72. In the operation of the apparatus, the control means is operative to cause the heating member 82 to be moved from its inoperative position to an operative position thereof with arrival at the operative position being signalled by a microswitch, be held at the operative position for a predetermined time, timed by the timer, and then be returned to its inoperative position. It is found that a time of between 4 and 8 seconds is suitable for many adhesives. The inner side plates 14 have apertures 101 therein to accommodate the edge of the carriage 56 when the heating member 82 is in its operative position.

At the operating station A of the apparatus, a wire mesh support 104 for a shoe part is positioned above the operative position of the heating member 82 at the station A. A shoe part in the form of a lasted shoe upper U can be positioned on the support 104 to be heated by infra-red radiation emitted by the upper heating surface 86 of the heating member 82. The heating member 82 is thus mounted for movement between an operative position thereof in which the heating member 82 is in opposed relationship with the support 104, and an inoperative position in which the heating member 82 is substantially enclosed by infra-red radiation reflecting screens. The support 104 is supported by the rail 50 and the side plate 14.

At the station B of the apparatus, a further support 104 for a lasted shoe upper U is positioned above the operative position of the heating member 82 at the station B. The heating member 82 is thus movable to a further operative position thereof in which the heating member 82 is in opposed relationship with the further support 104. In moving between its operative positions, the heating member 82 passes through its inoperative position and can rest there if no shoe part is awaiting activation. The control means is operative to cause the heating member 82 to be moved to its two operative positions alternatively on alternate operations of the start button 102.

A support rod 106 supported by the side plates 12 and 14 extends transversely across the apparatus, passing through holes in the plates 22. Two supports 108 for a sole S are pivotally mounted on the rod 106, one at the station A and the other at the station B. The supports 108 are for soles S to be attached to the lasted upper U. The supports 108 are arranged opposite the supports 104 but below the operative position of the heating member 82. Thus, when the heating member 82 is in its operative position, the heating member 82 can simultaneously heat both a lasted shoe upper U with its upper heating surface 86 and a sole S with its lower heating surface 88.

Each support 108 comprises a frame 110 which supports a wire mesh 112 on which the toe and waist regions of a sole S can be supported. To support a heel of a sole S on the support 108 a heel support 114 is pivotally adjustable relative to the remainder of the support 108 being mounted to pivot about a rod 116 carried by the frame 110. The heel support 114 comprises a plurality of parallel fiber glass cords 118 coated with silicon rubber stretched across a frame 120. The heel can be supported with at least one of the cords 118 engaging its rear surface. The frame 120 is supported by a pin 122 inserted in one of a series of holes in a plate 124 which projects downwardly from the frame 110. The frame 110 is also supported by pins (not shown) which project into holes in the plates 22 and 14 and serve to hold the frame 110 at a selected angle about the rod 106.

So that the apparatus can be used either to heat a single shoe part at a time or alternatively to heat a lasted shoe upper U and a sole S simultaneously, the heating member 82 is provided with two alternative thermostats (not shown) which allow the heating member 82 to be maintained at two alternative temperatures, a first temperature between 540° C. and 500° C. which is suitable for heating single shoe parts, or a second temperature between 390° C. and 350° C.

I claim:

1. An apparatus for use in heating a shoe part to activate adhesive on a surface thereof, the apparatus comprising: a heating plate member arranged to emit infra-red radiation; and a support for a shoe part on which a shoe part can be positioned to be heated by infra-red radiation emitted by the heating member, wherein the heating member is mounted for movement between a pair of operative positions thereof in which the heating member is operated in opposed static relationship with the support, and an inoperative position thereinbetween in which the heating member is substantially enclosed by infra-red radiation reflecting screens.

2. An apparatus as recited in claim 1, wherein the apparatus comprises a further support for a shoe part and the heating member is movable to a further operative position thereof in which the heating member is in opposed relationship with the further support.

3. An apparatus as recited in claim 2, wherein the heating member is arranged to pass through its inoperative position in moving between its operative positions.

4. An apparatus as recited in claim 2, wherein the apparatus comprises control means operative to control moving means of the apparatus which is operable to move the heating member as aforesaid, the control means being operative to cause the heating member to be moved from its inoperative position to an operative position thereof, be held at the operative position for a predetermined time, and then be returned to its inoperative position.

5. An apparatus as recited in claim 4, wherein the predetermined time is between 4 and 8 seconds.

6. An apparatus as recited in claim 4, wherein the control means is operative to cause the heating member to be moved to its two operative positions alternately.

7. An apparatus as recited in claim 6 wherein the support is arranged to support a lasted shoe upper and the apparatus also comprises a support for a sole to be attached to a lasted shoe upper, the support for a sole being arranged opposite the support for a lasted shoe upper so that the heating member when in its operative position can simultaneously heat both a lasted shoe upper and a sole.

8. An apparatus as recited in claim 7, wherein the support for a sole comprises a heel support which is pivotally adjustable relative to the remainder of the support, the heel support being arranged to support the heel of a sole supported by the support.

9. An apparatus as recited in claim 8, wherein the heel support comprises a plurality of parallel cords stretched across a frame, the arrangement being such that a heel can be supported with at least one of the cords engaging its rear surface.

10. An apparatus as recited in claim 9, wherein the heating member is in the form of a plate of greater extent than the support for a shoe part, the plate having electrical heaters embedded therein.

11. An apparatus as recited in claim 10, wherein the heating member comprises two generally planar portions inclined to one another at an angle of between 140° and 160°.

12. An apparatus as recited in claim 11, wherein edges of the heating member are substantially enclosed in infra-red radiation reflecting screens which move with the heating member, these screens assisting in enclosing the heating member when it is in its inoperative position.

13. An apparatus as recited in claim 12, wherein infra-red radiation reflecting screens which move with the heating member, which heating member has a periphery, and which screens extend from the periphery of the heating member so that, when the heating member is in an operative position thereof, the screens direct infra-red radiation towards the support.

14. An apparatus as recited in claim 13, wherein the heating member comprises an array of ceramic blocks having electrical heating elements passing from block to block.

15. An apparatus as recited in claim 14, wherein the heating member is arranged to be maintainable at two alternative temperatures.

* * * * *